US008402574B2

(12) United States Patent
Murphy

(10) Patent No.: US 8,402,574 B2
(45) Date of Patent: Mar. 26, 2013

(54) BATH

(75) Inventor: Peter James Murphy, Pattya (TH)

(73) Assignee: Kohler New Zealand Ltd., Auckland (NZ)

( * ) Notice: Subject to any disclaimer, the term of this patent is extended or adjusted under 35 U.S.C. 154(b) by 0 days.

(21) Appl. No.: 12/678,064

(22) PCT Filed: Sep. 15, 2008

(86) PCT No.: PCT/NZ2008/000242
§ 371 (c)(1),
(2), (4) Date: Dec. 7, 2011

(87) PCT Pub. No.: WO2009/035350

PCT Pub. Date: Mar. 19, 2009

(65) Prior Publication Data

US 2012/0084910 A1 Apr. 12, 2012

(30) Foreign Application Priority Data

Sep. 14, 2007 (NZ) ..... 561554

(51) Int. Cl.
*A47K 3/02* (2006.01)

(52) U.S. Cl. ..... 4/584

(58) Field of Classification Search ..... 4/538–595, 4/619

See application file for complete search history.

(56) References Cited

U.S. PATENT DOCUMENTS 4,533,042 A * 8/1985 Pollacco ..... 206/223
5,715,546 A * 2/1998 Kvalvik ..... 4/580
6,691,337 B1 2/2004 Banks

FOREIGN PATENT DOCUMENTS

| | | |
|---|---|---|
| DE | 3134256 | 3/1983 |
| DE | 3134256 A1 * | 3/1983 |
| DE | 202006019171 UI | 3/2007 |
| GB | 2222767 | 3/1990 |
| JP | 2001003426 | 6/1999 |
| JP | 2000342468 | 12/2000 |
| JP | 2001104191 | 4/2001 |
| WO | 9311729 | 6/1993 |

OTHER PUBLICATIONS

The International Search Report and Written Opinion as mailed on Jun. 19, 2009 for International Patent Application PCT/NZ2008/000242.

The International Preliminary Report on Patentability for International Patent Application PCT/NZ2008/000242, Sep. 15, 2008.

* cited by examiner

*Primary Examiner* — Lori Baker
(74) *Attorney, Agent, or Firm* — Foley & Lardner LLP

(57) ABSTRACT

A bath has a drain outlet at the end of the bath which is also that end designed to be the most comfortable for reclining against by a user. The bath may also comprise a removable cover having one part which when the cover is in place in the bath fits over the drain outlet and is substantially flush with the floor of the bath and another part which extends up an adjacent wall section of the bath substantially to a rim of the bath, for assisting in supporting a person sitting in the bath over or adjacent the drain outlet and reclining against the wall of the bath.

18 Claims, 7 Drawing Sheets

BATH

CROSS-REFERENCE TO RELATED APPLICATIONS

The present application claims the benefit of New Zealand Patent Application No. 561554 filed Sep. 14, 2007, and the benefit of PCT International Application No. PCT/NZ2008/000242 filed on Sep. 15, 2008, both applications are incorporated herein by reference.

FIELD OF INVENTION

The invention comprises an improved form of bath.

BACKGROUND OF THE INVENTION

A standard bath has a drain outlet in the lowermost part of the floor of the bath for draining the bath of water after use, which is closed by a separate or pop-up plug. Commonly the drain outlet is provided in floor of the bath adjacent one end of the bath. Commonly the end wall section of the bath at the opposite end of the bath to the drain is shaped so as to be as comfortable as possible to a person sitting in the bath and reclining against this end of the bath. Commonly this end wall section of the bath opposite the drain end of the bath extends upwardly at a greater angle away from the floor of the bath than does the end wall section of the bath at the drain end of the bath. Commonly this end wall section at the end of the bath is also approximately convexly curved over at least a part of its height, to make the bath as comfortable as possible for a person reclining against the bath wall.

SUMMARY OF THE INVENTION

It is an object of the invention to provide an improved or at least alternative form of bath, which provides additional comfort.

In broad terms in one aspect the invention comprises a bath having a drain outlet at the deepest part of the bath and provided adjacent an end wall section of the bath which extends upwardly at an angle to the floor of the bath greater than an angle to the floor of an opposite end wall of the bath and/or which is approximately convexly curved over at least part of the height of the end wall section.

Preferably the drain outlet is provided in a recess in the floor of the bath and the bath comprises a cover over the drain outlet (separate from a plug of the drain outlet).

In broad terms in another aspect the invention comprises a bath comprising a floor and a surrounding wall, the floor and wall together defining the bath cavity, a drain outlet in a recess in a lowermost part of the floor of the bath, and a cover over the drain outlet, which when in place is substantially flush with the floor of the bath and extends up an adjacent wall section of the bath for assisting in supporting a person sitting in the bath over or adjacent the drain outlet and reclining against the wall of the bath.

Preferably the cover also extends at least part way up an adjacent wall section of the bath.

Preferably the adjacent wall section of the bath is approximately convexly curved over at least part of the height of the wall section for user comfort.

Preferably the cover is formed from a resiliently compressible material and/or a material which is softer then the material from which the bath wall is formed.

Preferably the cover extends upwardly to a rim of the bath to also provide a pillow for a person sitting in the bath and reclining against the wall of the bath.

Preferably the bath comprises one or more water inlets for filling the bath, at or towards an upper portion of the wall section of the bath, and the cover is shaped to conceal the water inlets when the cover is in place but to define a cavity between the cover and the bath wall behind the cover, for water flow into the bath from behind the cover so that the bath maybe filled with the cover in place.

The term "comprising" as used in this specification means "consisting at least in part of". When interpreting each statement in this specification that includes the term "comprising", features other than that or those prefaced by the term may also be present. Related terms such as "comprise" and "comprises" are to be interpreted in the same manner.

BRIEF DESCRIPTION OF THE DRAWINGS

The invention is further illustrated by the following description of preferred embodiments by way of example and without intending to be limiting.

DETAILED DESCRIPTION OF PREFERRED FORM

Figure 1:
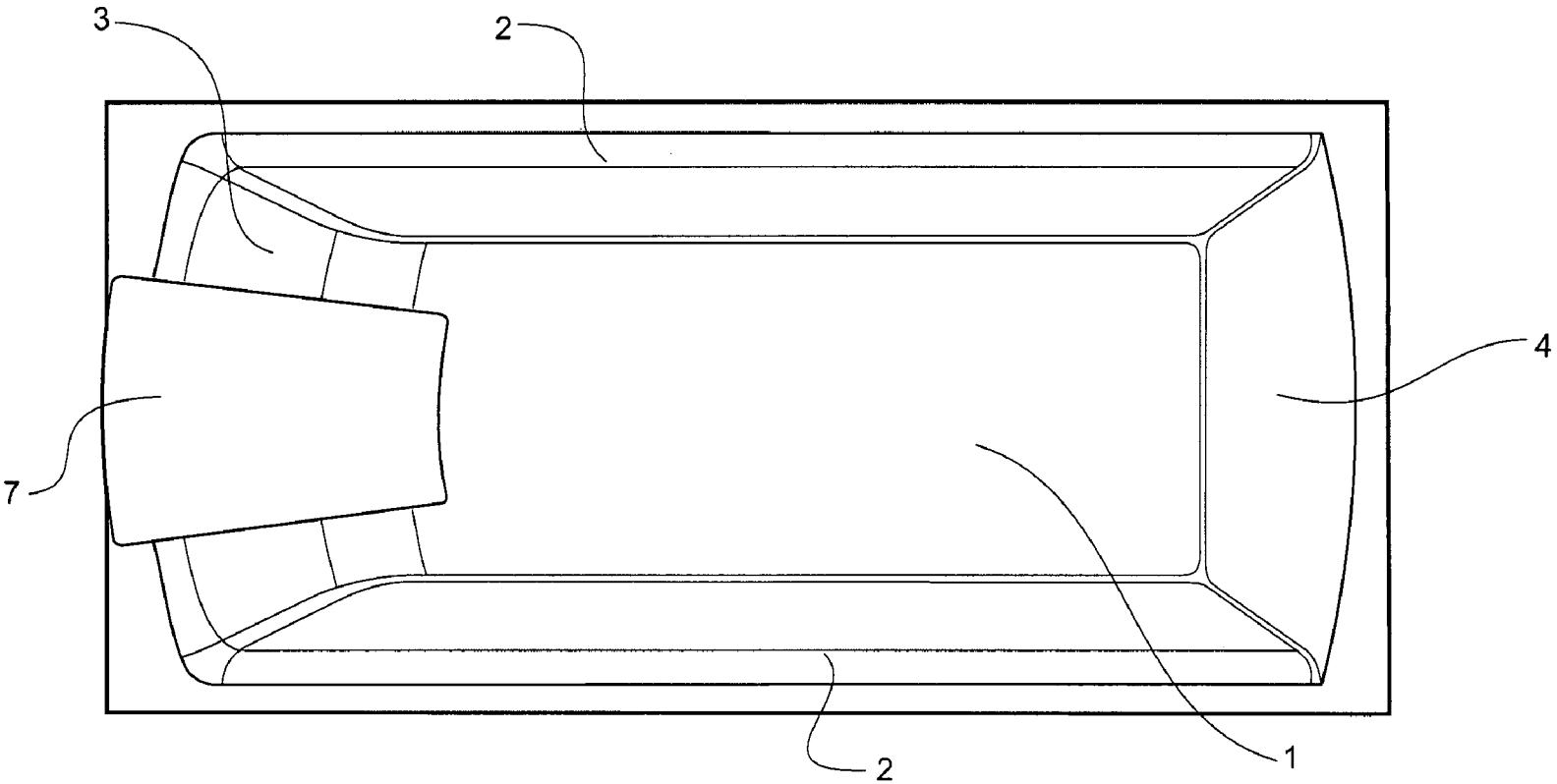
FIG. 1 is a plan view of a bath.
Figure 2:
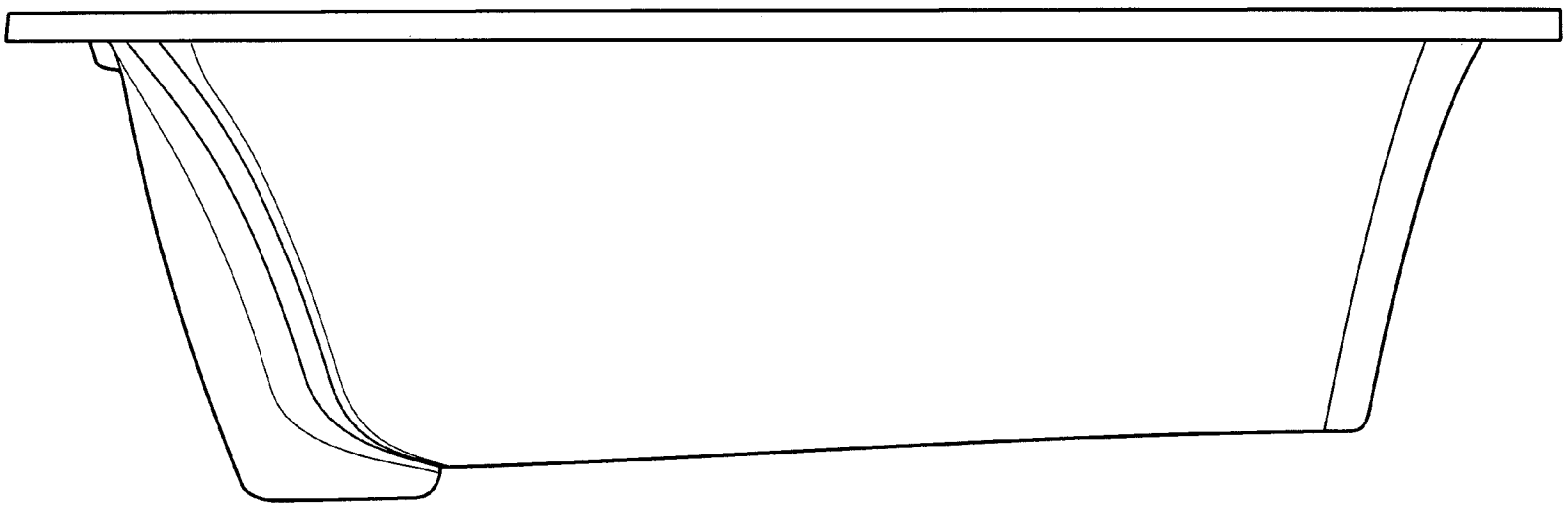
FIG. 2 is a view of the bath from one side.

Referring to the drawings the preferred embodiment bath shown in FIGS. 1 to 5 has an approximately rectangular shape as shown. By "bath" is meant predominantly the shell which defines a bath cavity for containing water, comprising the floor and surrounding wall and peripheral rim. In the drawings the floor of the bath is indicated at 1. The bath wall comprises a longer side sections 2 and end sections 3 and 4. The bath may be formed of a thermoplastic material, porcelain-on-steel, or enamel coated cast iron for example.

The bath has an end wall section 3 which extends upwardly at an angle to the floor 1 of the bath, which angle is greater than the angle of the opposite end wall section 4 to the bath floor 1. Additionally this end wall section 3 of the bath is approximately convexly curved over it's height as shown. The end wall 3 is thus the more comfortable for a person sitting in the bath and reclining against an end wall of the bath, then the opposite end wall 4. However in other embodiments this end wall 3 may be inclined at the same angle as the opposite end wall of the bath but convexly shaped, or vice versa, or may be otherwise shaped in such a way as to make it the most comfortable bath wall section for reclining against by a user.

Figure 3:
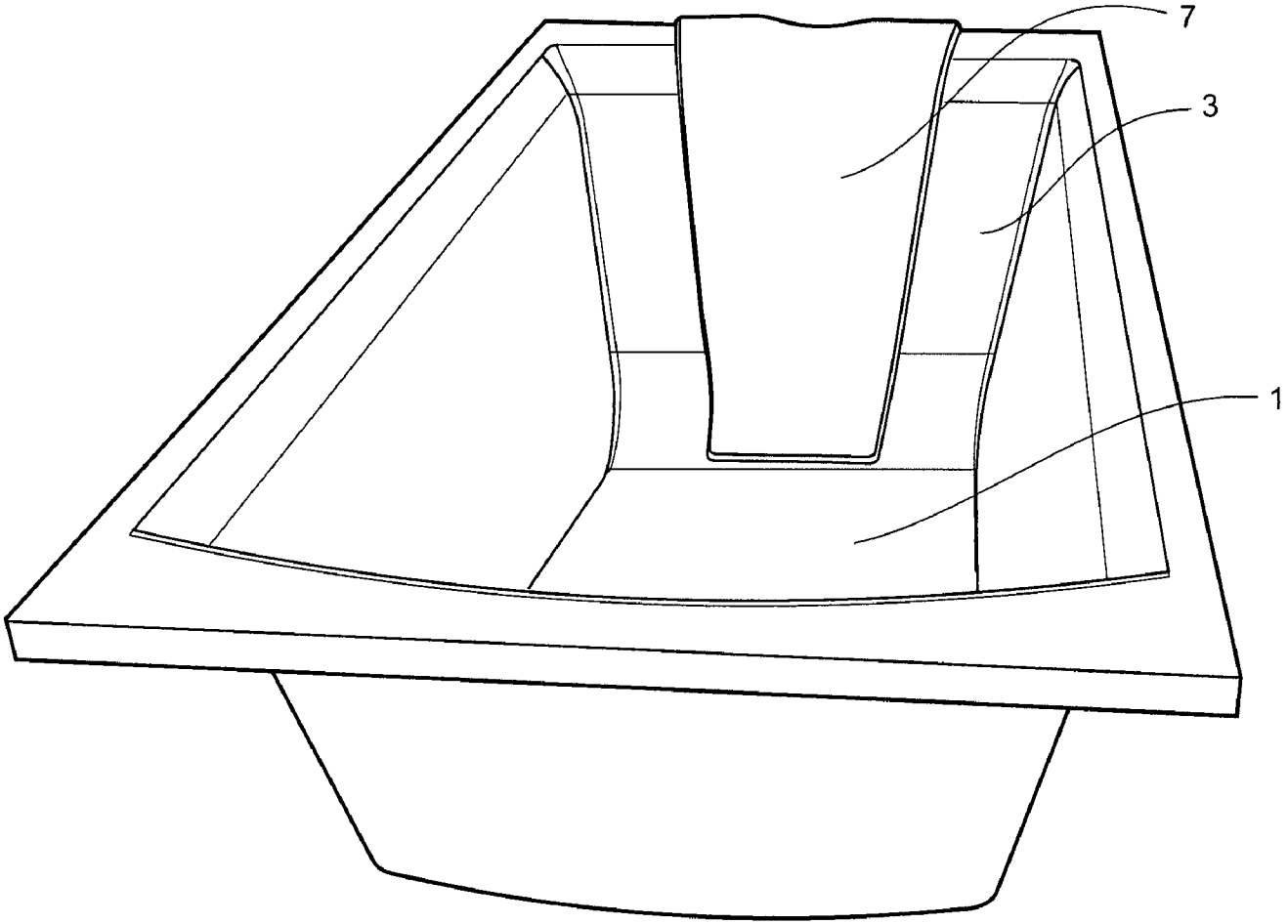
FIG. 3 is a view of the bath from above one end with the cover there of in place.
Figure 4:
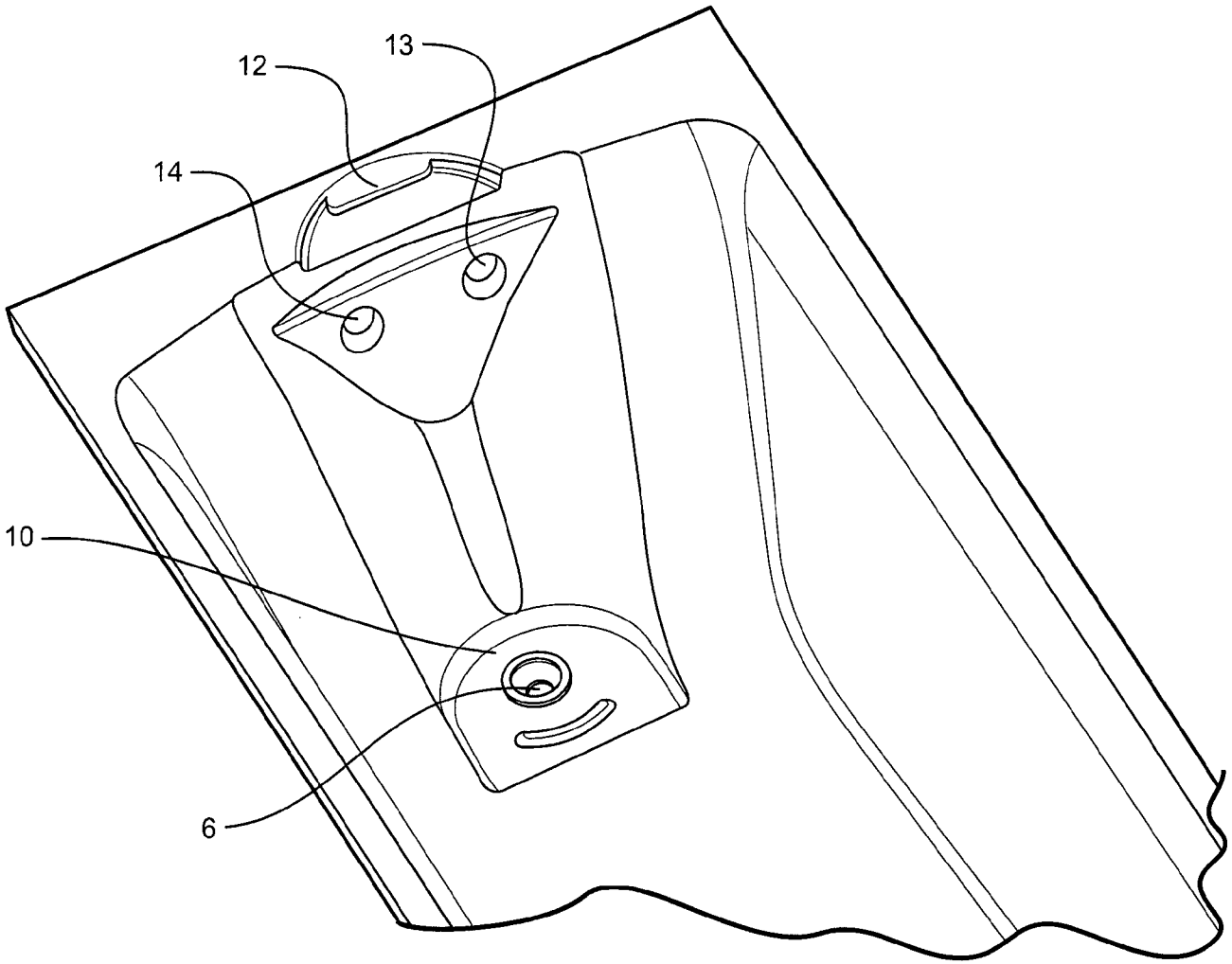
FIG. 4 is a view of the end of the bath of FIG. 3 with the cover removed.
Figure 5:
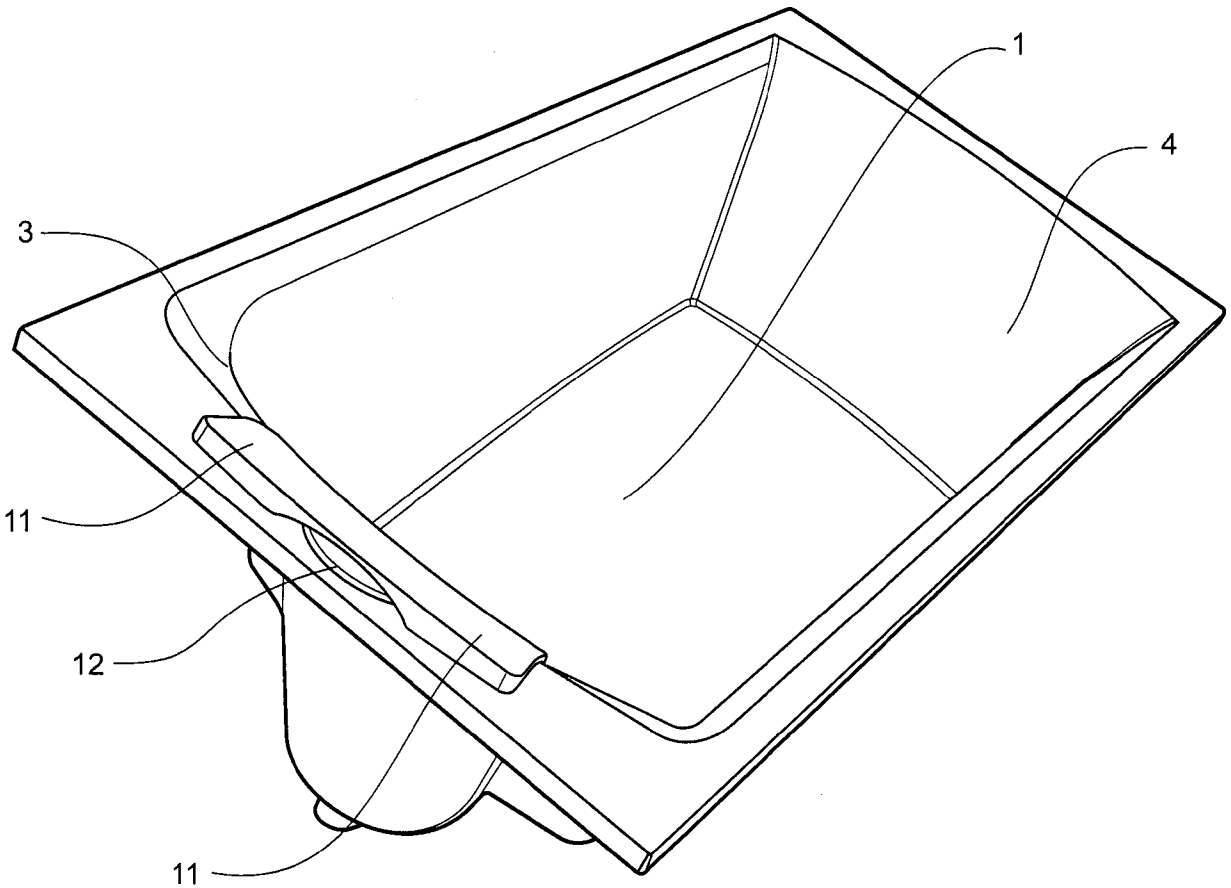
FIG. 5 is a view of the bath from above the other end.

The drain 6 is provided at this end 3 of the bath. That is, the end wall of the bath which is designed to be the most comfortable for reclining against by a user is provided in the lowermost part of the floor of the bath, being that end of the bath at which the water in the bath will be deepest when the bath is in use (the terms upper and lower are used assuming that the bath is in it's normal orientation). A cover generally indicated at 7 is provided. Alternative embodiments of the cover are shown in FIGS. 6 and 7. In both embodiments the cover 7 is shaped so as to fit in a recess 10 in the floor and also bath wall, in which the drain outlet 6 is provided. The recess 10 also extends up the end wall section 3. FIG. 4 shows the end of the bath with the cover removed, while FIGS. 1, 3 and 5 show the cover 7 in place. In the preferred form, when the cover is in place it's upper or outer surface is substantially flush with the surrounding floor and wall surfaces of the bath, around the recess 10 into which the cover fits. This is intended to include that the cover maybe designed to sit slightly proud of the bath surface(s), particularly if the cover 7 is formed from a resiliently compressible material such as an expanded foam material for user comfort as is preferred.

Figure 6B:
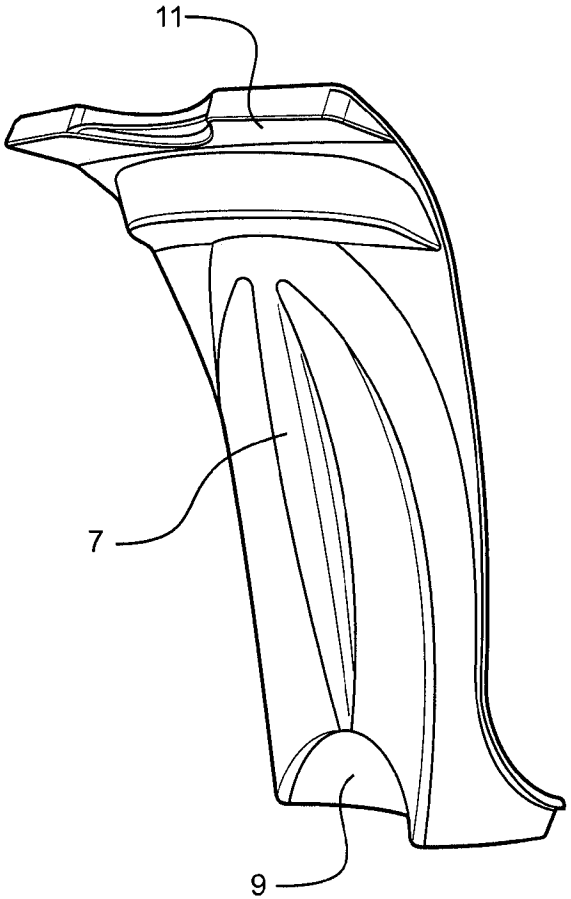
FIG. 6A is a view of one embodiment of a cover from the front and FIG. 6B is a view of this embodiment of the cover from the rear.
Figure 6A:
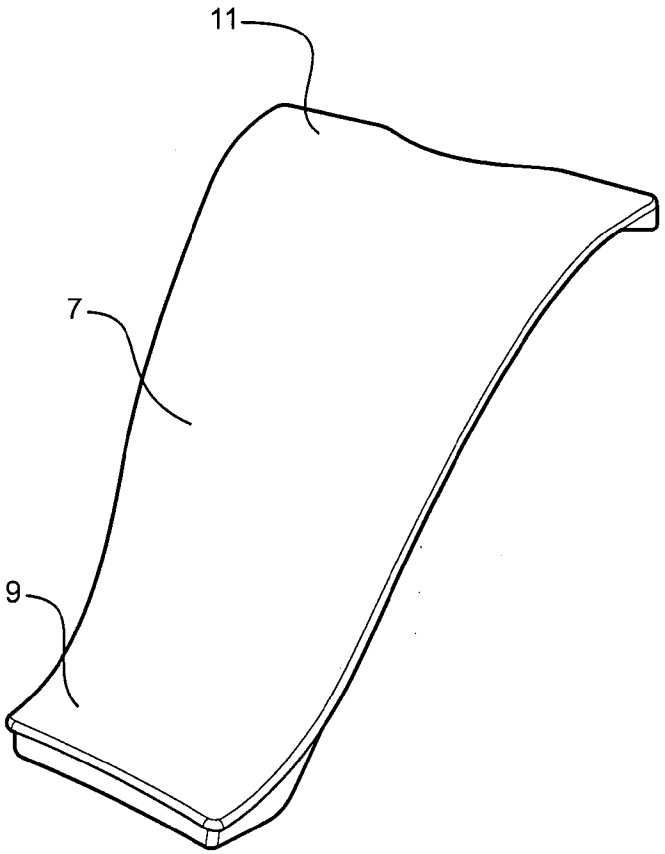

Referring to FIGS. 6A and 6B, which show a first embodiment of the cover 7, the cover 7 fits into the recess 10 in the end wall of the bath and acts as a back rest for the bather, and has part 9 which covers the drain outlet 6 and plug therein, and part 11 which extends upwardly to a rim of the bath to also provide a pillow for the person sitting in the bath and reclining against the wall of the bath. In this embodiment it is not necessary to remove the cover each time that the bath is filled and/or drained. The drain outlet 6 may be closed by a pop-up plug (not shown) which in turn is controlled by a linkage having a handle 12 part which is manipulated by the user, slightly exposed under the pillow part 11 of the cover 7 at the rim of the bath, as shown in FIG. 5. The handle 12 is also shown in FIG. 4. The handle is connected to the pop-up plug via a linkage of known type.

In this embodiment and more generally in one form of the bath, by "cover" over the drain is meant something separate from the plug itself. Also, the cover 7 is designed so that it is not necessary to remove the cover to drain the bath, although the cover is separately formed from the bath shell and is removable for cleaning. That is, operation of the pop-up drain to lift the plug enables the bath to be drained, by water in the bath draining below the lower part 9 of the cover into the recess 10 behind the cover, and out through the drain outlet 6. In a variation Of this embodiment still comprising a cover and separate plug, a pop-up drain may not be provided, and the drain outlet 6 may be closed with a conventional plug which is manually placed in and removed from the drain to fill and drain the bath, after removal of the cover 7, but this is less preferred.

Figure 7B:
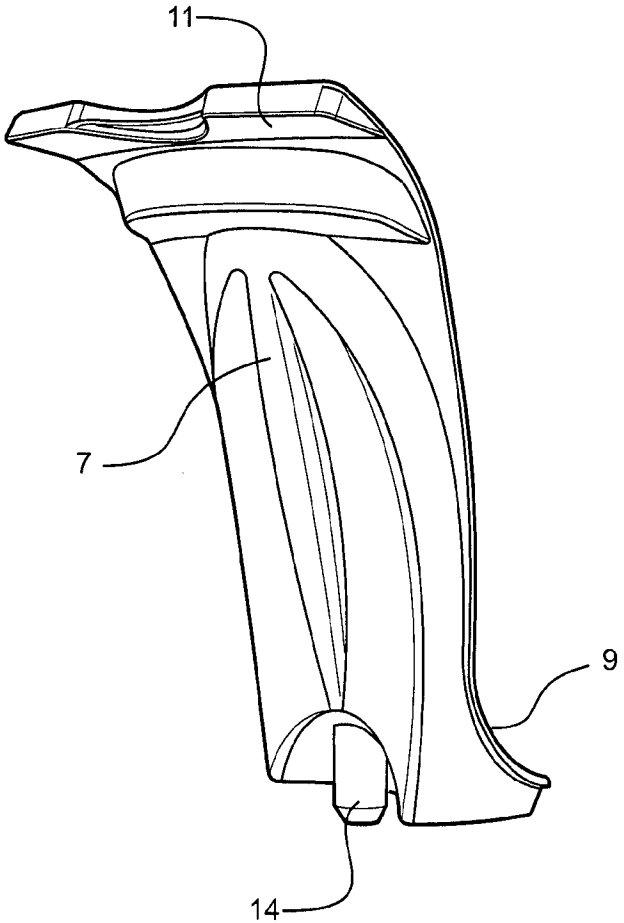
FIG. 7A is a cross-section view of another embodiment of a cover and FIG. 7B is a view of this embodiment of the cover from the rear.
Figure 7A:
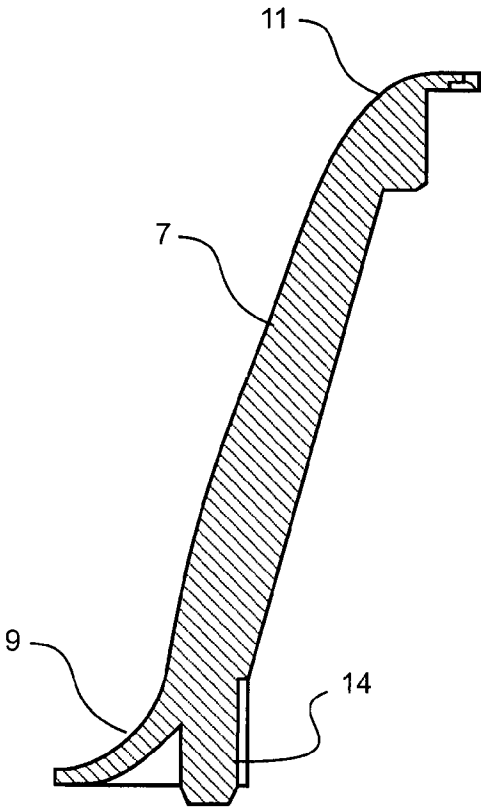

FIGS. 7A and 7B show another embodiment in which the cover and .a plug are integrated. A plug part 14 is integrally formed on and projects below the underside of the cover 7, which fits into and closes the drain when the cover is in place. Then, to drain the bath after use, removal of the cover or alternatively simply partial lifting or tilting of the cover by for example raising its upper end, will withdraw the plug part 14 on the underside of the cover from the drain, to allow the bath to empty. The cover is then dropped back into place, or if removed altogether is refitted in place at least before it is subsequently desired to refill the bath.

In the embodiments shown in the drawings, the cover 7 also conceals hot and cold water inlets 13 and 14 into the bath, for filling the bath. The hot and cold inlets 13 and 14 are provided in a recess in the end wall 3 of the bath as shown, and are connected to hot and cold piping and control taps external to the bath. In an alternative embodiment a single water inlet maybe provided behind the cover 7, which is connected to a hot-cold mixer. To fill the bath the drain is closed and the taps or mixer are operated to allow water to flow into the bath. Water flows down in a cavity defined behind the cover and between the recess in the bath end wall and under the cover, to fill the bath. To subsequently empty the bath the drain is operated to release the plug.

In a spa embodiment of the bath, the cover 7 may also conceal an inlet or inlets by which water is taken from the bath, and recirculated by a pump and optionally through a heater, to be returned to the bath through one or more spa outlets. A number of spa outlets may be provided spaced around the bath walls as is known, or alternatively one or more spa outlets may be provided behind the cover 7 to direct water back into the bath through an aperture in the cover. Alternatively again a space or spaces (gap) may be provided between the side edges of the cover on either side and the bath wall, and a spa outlet or outlets arranged to direct water back into the bath from around either side of the cover. A combined inlet and outlet spa fitting or fittings may be provided behind the cover. Air may be pumped into the bath water via an outlet or outlets behind the cover.

The benefits of the invention include that a user may comfortably sit at the lower or in use deepest end of the bath. This is precluded in conventional baths, which are shaped so that the most comfortable end of the bath is that opposite the drain end of the bath. A benefit of providing cover 7 as in the preferred embodiment, which also extends up the end wall of the bath and which is formed of a resiliently compressible material, is that additional comfort is provided at the part of the bath wall against which the bathers spine will rest. The invention enables the bathing experience to be enhanced, and also provides a clean uncluttered appearance to the bath.

The preferred embodiment bath shown in the drawings and described in detail above has an approximately rectangular shape with one end of the bath designed to be the most comfortable for sitting at and reclining against the end wall by a user. In alternative embodiments the bath may be designed so that it is comfortable for persons to sit at either end of the bath (a two person or more bath). One of the two ends of the bath is still deeper and comprises a drain 6 and cover 7 as described previously. The other end of the bath may be provided with a removable (or fixed) back rest in a form similar to the cover 7. In an alternative form again the bath may have for example a circular, oval, or elliptical shape (when viewed in plan), a square shape, or a triangular shape or similar, for example, and be designed for seating multiple occupants. At multiple seating positions the bath may be provided with a removable (or fixed) back rest in a form similar to the cover 7, at least one of which extends over a drain outlet from the bath as described above.

The foregoing describes the invention including a preferred form thereof. Alterations and modifications as will be obvious to those skilled in the art are intended to be incorporated in the scope hereof as defined in the accompanying claims.

The invention claimed is:

1. A bath comprising:

an end wall section, a floor, and an opposite end wall;

a drain outlet provided in a recess of the floor at a deepest part of the bath and provided adjacent the end wall section; and a cover over the drain outlet;

wherein the end wall section extends upwardly at an angle to the floor greater than an angle to the floor of the opposite end wall of the bath, or is approximately convexly curved over at least part of a height of the end wall section;

wherein the cover comprises an integral plug on an underside thereof, the integral plug being configured for closing the drain outlet when the cover is in place in the bath and for being removed from the drain outlet when the cover is removed from the bath; and wherein the bath is configured to receive a person therein.

2. A bath comprising:

an end wall section, a floor, and an opposite end wall;

a drain outlet provided at a deepest part of the bath and provided adjacent the end wall section;

one or more water inlets for filling the bath, the water inlets being arranged at or towards an upper portion of the end wall section of the bath; and a cover shaped to conceal the water inlets when the cover is positioned over the water inlets, the cover defining a cavity between the cover and the bath wall behind the cover for water flow into the bath from behind the cover so that the bath maybe filled with the cover in place;

wherein the end wall section extends upwardly at an angle to the floor greater than an angle to the floor of the opposite end wall of the bath, or is approximately convexly curved over at least part of a height of the end wall section;

and wherein the bath is configured to receive a person therein.

3. The bath according to claim 2 wherein the drain outlet is provided in a recess in the floor of the bath and the cover is over the drain outlet.

4. The bath according to claim 3 wherein the cover comprises an integral plug on an underside thereof, the integral plug being configured for closing the drain outlet when the cover is in place in the bath and for being removed from the drain outlet when the cover is removed from the bath.

5. The bath according to claim 4 wherein the cover also extends at least part way up the end wall section of the bath.

6. The bath according to claim 5 wherein the cover extends upwardly to a rim of the bath to provide a pillow for a person sitting in the bath and reclining against the end wall section of the bath.

7. A bath comprising:

a floor and a surrounding wall, the floor and wall together defining a bath cavity;

a drain outlet in a recess in a lowermost part of the floor of the bath;

one or more water inlets for filling the bath, the water inlets being arranged at or towards an upper portion of the wall section of the bath; and a cover over the drain outlet;

wherein the cover is substantially flush with the floor of the bath and extends up an adjacent wall section of the bath to assist supporting a person seated in the bath, the person being over or adjacent the drain outlet and reclining against the wall of the bath; and wherein the cover is shaped to conceal the water inlets when the cover is positioned over the water inlets, the cover defining a cavity between the cover and the bath wall behind the cover for water flow into the bath from behind the cover so that the bath may be filled with the cover in place.

8. The bath according to claim 7 wherein the adjacent wall section of the bath is approximately convexly curved over at least part of a height thereof for user comfort.

9. The bath according to claim 7 wherein the cover comprises an integral plug on an underside thereof, the integral plug being configured for closing the drain outlet when the cover is in place in the bath and for being removed from the drain outlet when the cover is removed from the bath.

10. The bath according to claim 7 wherein the cover is formed from a resiliently compressible material and/or a material which is softer then the material from which the bath wall is formed.

11. The bath according to claim 7 wherein the cover extends upwardly to a rim of the bath to provide a pillow for a person sitting in the bath and reclining against the wall of the bath.

12. A bath comprising:

a floor and a surrounding wall, the floor and wall together defining the bath cavity;

a drain outlet in a recess in a deepest part of the floor of the bath and a removable cover configured to be placed in the bath, the removable cover comprising:

a first part which fits over the drain outlet and is substantially flush with the floor of the bath; and a second part which extends up an adjacent wall section of the bath substantially to a rim of the bath, to assist supporting a person seated in the bath over or adjacent the drain outlet and reclining against the wall of the bath.

13. The bath according to claim 12 wherein the adjacent wall section of the bath is approximately convexly curved over at least part of height of the adjacent wall section for user comfort.

14. The bath according to claim 13 wherein the cover comprises an integral plug on an underside thereof, the integral plug being configured for closing the drain outlet when the cover is in place in the bath and for being removed from the drain outlet when the cover is removed from the bath.

15. The bath according to claim 14 further comprising one or more water inlets for filling the bath, the water inlets being arranged at or towards an upper portion of the end wall section of the bath;

wherein the cover shaped to conceal the water inlets when the cover is positioned over the water inlets, the cover defining a cavity between the cover and the bath wall behind the cover for water flow into the bath from behind the cover so that the bath maybe filled with the cover in place.

16. A bath comprising:

a floor and a surrounding wall, the floor and wall together defining the bath cavity;

a drain outlet in a recess in a deepest part of the floor of the bath; and a removable cover configured to be placed in the bath, the removable cover comprising:

a first part which fits over the drain outlet, is substantially flush with the floor of the bath, and includes on an underside thereof an integral plug which closes the drain outlet when the cover is in place in the bath and which is removed from the drain outlet when the cover is removed from the bath; and a second part which extends up an adjacent wall section of the bath substantially to a rim of the bath to assist supporting a person seated in the bath over or adjacent the drain outlet and reclining against the wall of the bath.

17. The bath according to claim 16 wherein the adjacent wall section of the bath is approximately convexly curved over at least part of a height thereof for user comfort.

18. A removable cover component for a bath, the removable cover component comprising:

a first cover part configured to sit over a drain outlet of the bath and having on an underside thereof an integral plug configured to close the drain outlet; and a second cover part which is cranked relative to the first cover part and is larger than the first cover part, the second cover part being configured to extend up a wall section of the bath adjacent the drain outlet towards a rim of the bath to assist in supporting a person sitting in the bath over or adjacent the drain outlet and reclining against the wall of the bath.

* * * * *